US008991960B2

(12) United States Patent
Hargis et al.

(10) Patent No.: US 8,991,960 B2
(45) Date of Patent: Mar. 31, 2015

(54) COMPENSATION OF BI-DIRECTIONAL ALIGNMENT ERROR

(75) Inventors: Greg Hargis, Vancouver, WA (US); Yifeng Wu, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 169 days.

(21) Appl. No.: 13/593,578

(22) Filed: Aug. 24, 2012

(65) Prior Publication Data

US 2014/0055514 A1 Feb. 27, 2014

(51) Int. Cl.
*B41J 29/38* (2006.01)
*B41J 29/393* (2006.01)
*B41J 19/14* (2006.01)

(52) U.S. Cl.
CPC ..... *B41J 19/145* (2013.01)
USPC ..... 347/12; 347/19

(58) Field of Classification Search
CPC ..... B47J 2/04573; B47J 2/04505
See application file for complete search history.

(56) References Cited

U.S. PATENT DOCUMENTS 5,448,269 A * 9/1995 Beauchamp et al. ..... 347/19
5,600,350 A * 2/1997 Cobbs et al. ..... 347/19
6,234,602 B1 * 5/2001 Soto et al. ..... 347/19
6,361,137 B1 3/2002 Eaton
7,681,979 B2 3/2010 Huang
7,914,112 B2 3/2011 Hayashi
2008/0225074 A1 9/2008 Van de Wynckel et al.

OTHER PUBLICATIONS

Zhao, X. et al., "Ink Droplet Position Compensation Based on Extended State Observer," Int. J. of Automation Technolog, vol. 5, No. 5, pp. 629-630 (Jul. 20, 2011).

* cited by examiner

*Primary Examiner* — Shelby Fidler
*Assistant Examiner* — Tracey McMillion

(57) ABSTRACT

A method of compensating for bi-directional alignment error in a printing system including a carriage, a print head disposed thereon, and a bi-directional printing mode includes determining a data set by a data set determination module corresponding to bi-directional alignment error at a plurality of carriage speeds. The method also includes determining a line of best fit of the data set by a best fit determination module and identifying a flight time of fluid ejected from the print head and a carriage position error of the carriage from the line of best fit by an alignment parameter identification module. The method also includes compensating for the bi-directional alignment error by an error compensation module based on the flight time and the carriage position error.

21 Claims, 6 Drawing Sheets

COMPENSATION OF BI-DIRECTIONAL ALIGNMENT ERROR

BACKGROUND

Printing systems may include a print head disposed on a carriage that traverses a print zone in a forward direction and a reverse direction in a bi-directional printing mode. The print head may eject fluid such as ink drops onto the substrate in the print zone, while moving in the forward direction and the reverse direction in the bi-directional printing mode.

BRIEF DESCRIPTION OF THE DRAWINGS

Non-limiting examples are described in the following description, read with reference to the figures attached hereto and do not limit the scope of the claims. Dimensions of components and features illustrated in the figures are chosen primarily for convenience and clarity of presentation and are not necessarily to scale. Referring to the attached figures:

DETAILED DESCRIPTION

Figure 1:
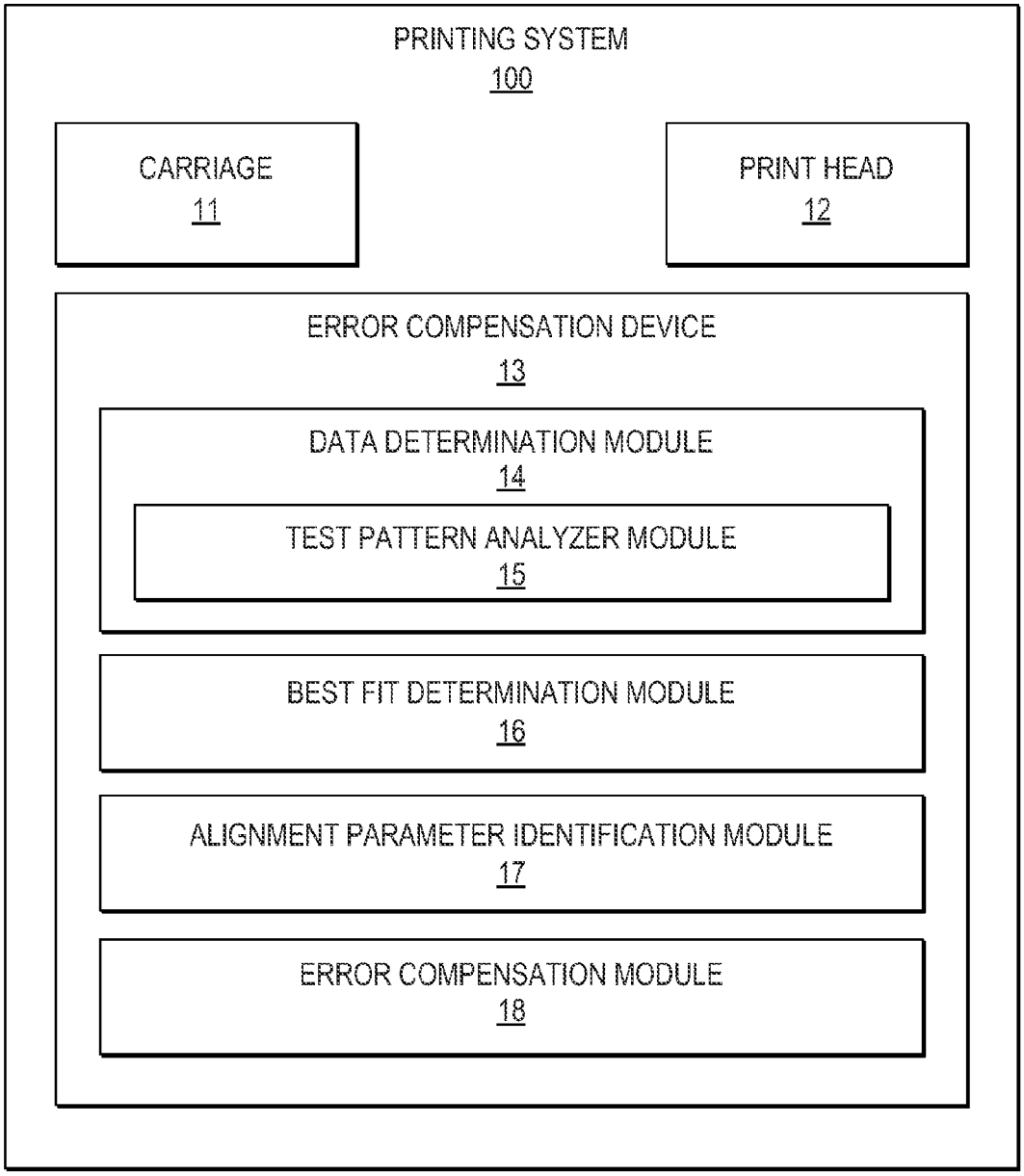
FIG. 1 is a block diagram illustrating a printing system according to an example.

Printing systems may include a print head disposed on a carriage that traverses a print zone in a mono-directional printing mode and/or a bi-directional printing mode. Printing systems may be inkjet printing system in which ink droplets are ejected from the print head disposed on a movable carriage and onto a substrate. In a mono-directional mode, the print head may eject ink drops when the carriage is moving the print head in a same direction. The actual placement of the ink drop may be offset from its intended location on the substrate due to motion of the print head. However, because the offset is in the same direction with each successive pass of the print head the placement error is minimized. Alternatively, a bi-directional printing mode, the print head may eject ink drops while the print head is moving, for example, in a forward direction and a reverse direction allowing increased printing speeds. However, the changing of direction of the carriage and the resulting change in direction of the placement error may result in alignment errors between subsequent passes of the print head. That is, bi-directional alignment error corresponds to an offset distance in which fluid such as an ink drop is offset from an intended location on a substrate due to printing in a bi-directional printing mode. As bi-directional alignment error may be influenced by various carriage speeds, the offset distance may vary across the sweep due to acceleration of the carriage. Simple corrective measures based on error distance may not be effective in reducing bi-directional alignment error in the entire print zone.

In examples, a method of compensating for bi-directional alignment error in a printing system including a carriage, a print head disposed thereon, and a bi-directional printing mode includes determining a data set by a data set determination module corresponding to bi-directional alignment error at a plurality of carriage speeds. The method also includes determining a line of best fit of the data set by a best fit determination module and identifying a flight time of fluid ejected from the print head and a carriage position error of the carriage from the line of best fit by an alignment parameter identification module. Flight time may be an amount of time from when fluid such as an ink drop is ejected from the print head 12 and contacts a substrate. Carriage position error may correspond to the carriage stopping and/or starting its change in direction at an incorrect position. Additionally, the method also includes compensating for the bi-directional alignment error by an error compensation module based on the flight time and the carriage position error. The use of flight time and carriage position error resulting from a data set of bi-directional errors at various carriage speeds may be effective in reducing bi-directional alignment error. Further, such corrective bi-directional alignment error measures may be performed in real-time using the respective printing system also as a diagnostic tool.

FIG. 1 is a block diagram illustrating a printing system according to an example. Referring to FIG. 1, in some examples, a printing system 100 includes a carriage 11, a print head 12 disposed on the carriage 11, and an error compensation device 13. The error compensation device 13 may include a data set determination module 14, a best fit determination module 16, an alignment parameter identification module 17, and an error compensation module 18. The data set determination module 14 may include a test pattern analyzer module 15 to analyze the test pattern and to provide a data set corresponding to the test pattern. In some examples, the test pattern analyzer module 15 may include at least one of a scanner and a sensor. For example, the test pattern analyzer module 15 may include a light emitting diode sensor to detect the test pattern.

Referring to FIG. 1, in some examples, the carriage 11 may move across a print zone in a forward direction and a reverse direction in a bi-directional printing mode. The print head 12 may eject fluid such as ink drops to a substrate to form an image in a print mode and to form a test pattern corresponding to the forward direction and the reverse direction in a test mode. A test mode may be a mode when the printing system 100 performs diagnostics on itself, for example, to determine and/or compensate for bi-directional alignment error. In some examples, the print head 12 may be an inkjet print head. The error compensation device 13 may compensate for bi-directional alignment error of the printing system 100. The data set determination module 14 may determine a data set corresponding to the bi-directional alignment error at a plurality of carriage speeds.

Referring to FIG. 1, in some examples, the best fit determination module 16 may determine a line of best fit of the data set. For example, the best fit determination module 16 may perform a line fitting algorithm. In some examples, the best fit determination module 16 may be configured to perform a simple linear regression to determine the line of best fit of the data set and to identify a formula including a slope and y-intercept corresponding to the line of best fit. For example, the line may be a straight line represented by the formula, y=mx+b, where m is the slope of the line, b is the y-intercept, y is a respective value along the y-axis, and x is a respective value along the x axis. The slope m represents a respective change in y divided by a respective change in x. That is, the slope m represents the steepness of the line.

Referring to FIG. 1, in some examples, the alignment parameter identification module 17 may identify a flight time of fluid ejected from the print head and a carriage position error of the carriage from the line of best fit. The flight time may correspond to the slope m of the formula corresponding to the line of best fit and the carriage position error may correspond to the y-intercept b of the formula corresponding to the line of best fit. The error compensation module 18 may compensate for bi-directional alignment error based on the flight time and the carriage position error. For example, this may be accomplished by adjusting the drop ejection time based on the flight time and adjusting the drop ejection position based on the carriage position error.

In some examples, an error compensation device 13, a data set determination module 14, a test pattern analyzer module 15, a best fit determination module 16, an alignment parameter identification module 17, and/or an error compensation module 18 may be implemented in hardware, software including firmware, or combinations thereof. The firmware, for example, may be stored in memory and executed by a suitable instruction-execution system. If implemented in hardware, as in an alternative example, the error compensation device 13, the data set determination module 14, the test pattern analyzer module 15, the best fit determination module 16, the alignment parameter identification module 17, and/or the error compensation module 18 may be implemented with any or a combination of technologies which are well known in the art (for example, discrete-logic circuits, application-specific integrated circuits (ASICs), programmable-gate arrays (PGAs), field-programmable gate arrays (FPGAs), and/or other later developed technologies. In other examples, the error compensation device 13, the data set determination module 14, the test pattern analyzer module 15, the best fit determination module 16, the alignment parameter identification module 17, and/or the error compensation module 18 may be implemented in a combination of software and data executed and stored under the control of a computing device.

Figure 2:
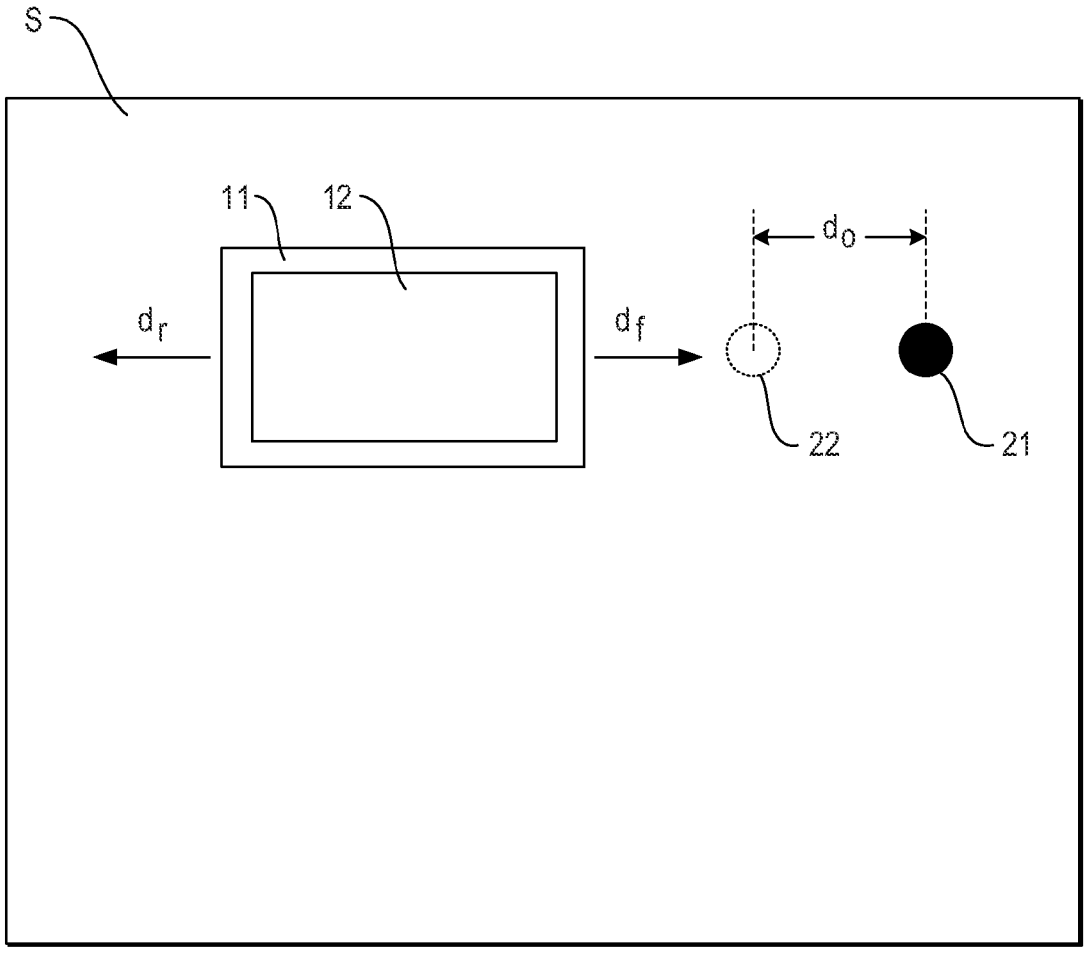
FIG. 2 is a top view of a substrate illustrating bi-directional alignment error corresponding to misplacement of an ink drop on the substrate ejected from a print head in a bi-directional printing mode according to an example.

FIG. 2 is a top view of a substrate illustrating bi-directional alignment error corresponding to misplacement of an ink drop on the substrate ejected from a print head in a bi-directional printing mode according to an example. Referring to FIG. 2, in some examples, a substrate S includes an ink drop 21 thereon ejected from a print head 12 and offset from its intended location 22 on the substrate S by a respective offset distance $d_o$. For example, the print head 12 disposed on a carriage 11 moving the print head 12 in a reverse direction $d_r$ in a bi-directional printing mode may have ejected the ink drop 21 there from. The print head 12 may also eject ink drops on the substrate S while moving in a forward direction $d_f$. As illustrated in FIG. 2, bi-directional alignment error may correspond to an offset distance $d_o$ in which fluid such as an ink drop 21 is offset from an intended location 22 on a substrate S due to printing in a bi-directional printing mode.

Figure 3A:
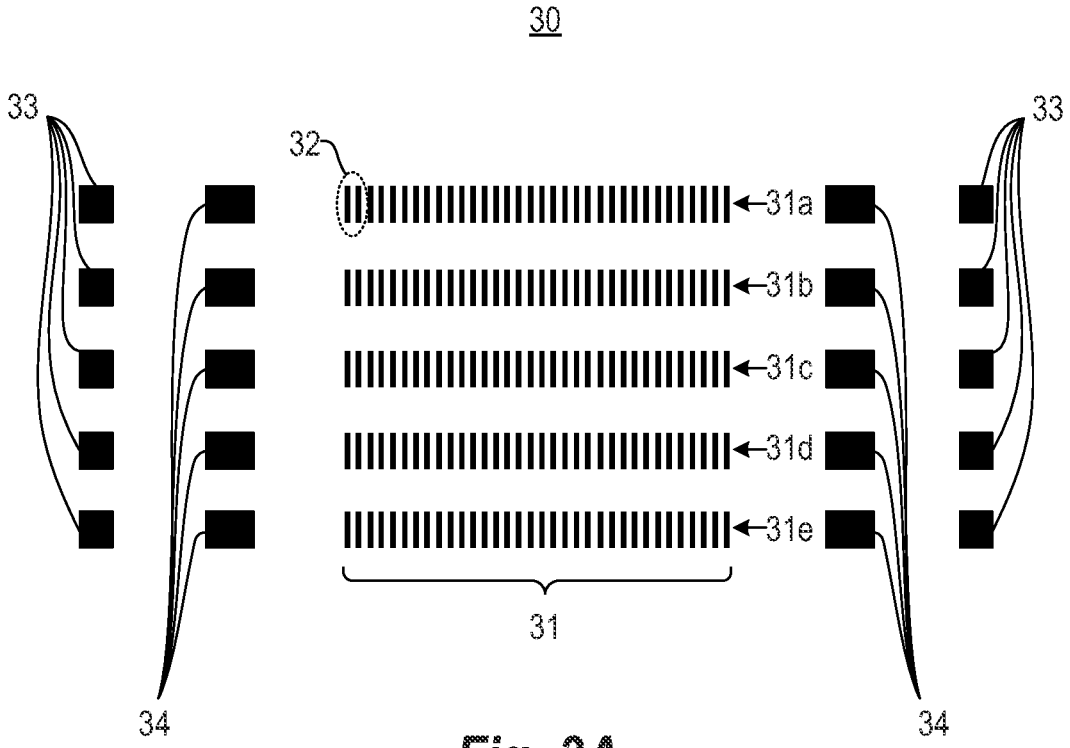
FIG. 3A is a top view illustrating a test pattern formed on a substrate by a printing system according to an example.
Figure 3B:
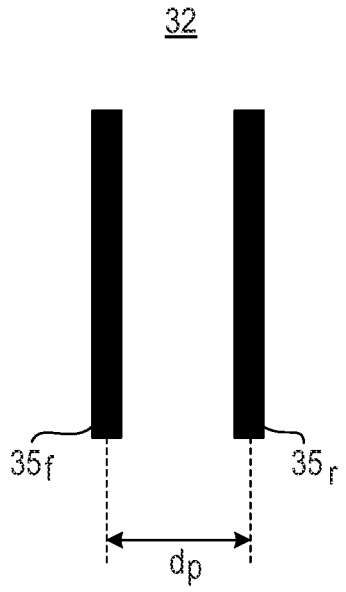
FIG. 3B is an exploded view illustrating a corresponding pair of vertical line patterns of the test pattern of FIG. 3A according to an example.

FIG. 3A is a top view illustrating a test pattern formed on a substrate by a printing system according to an example. FIG. 3B is an exploded view illustrating a corresponding pair of vertical line patterns of the test pattern of FIG. 3A according to an example. Referring to FIGS. 3A and 3B, in some examples, a test pattern 30 includes a first set of rows 31*a*, 31*b*, 31*c*, 31*d* and 31*e* of printed vertical line patterns. Each one of the respective rows 31*a*, 31*b*, 31*c*, 31*d* and 31*e* of printed vertical line patterns may correspond to a different carriage speed. A respective pairing distance $d_p$ between a corresponding pair of adjacent printed vertical line patterns 32 in the same row may correspond to bi-directional alignment error at the respective carriage speed. For example, for a corresponding pair 32 of vertical line patterns, a vertical line pattern $\mathbf{35}_f$ may be formed during a forward direction and a corresponding vertical line pattern $\mathbf{35}_r$ may be formed during a reverse direction in the bi-directional printing mode. The pairing distance $d_p$ between the corresponding vertical line patterns $\mathbf{35}_f$ and $\mathbf{35}_r$ may correspond to the respective bi-directional alignment error.

Referring to FIGS. 3A and 3B, in some examples, a warm up image 33 and a calibration image 34 may precede and follow each row 31*a*, 31*b*, 31*c*, 31*d* and 31*e* of the printed vertical line patterns. The respective warm up images 33 may establish a normal operating condition for the print head 12 to eject fluid to improve test pattern readability. Additionally, the respective calibration images 34 may enable a test pattern analyzer module 15 (FIG. 1) to orient and/or synch itself with respect to the respective vertical line patterns. This test pattern 30 may correspond to a respective print head 12. In some examples, a printing system 100 may include several print heads, and each one may have a corresponding test pattern.

Figure 4:
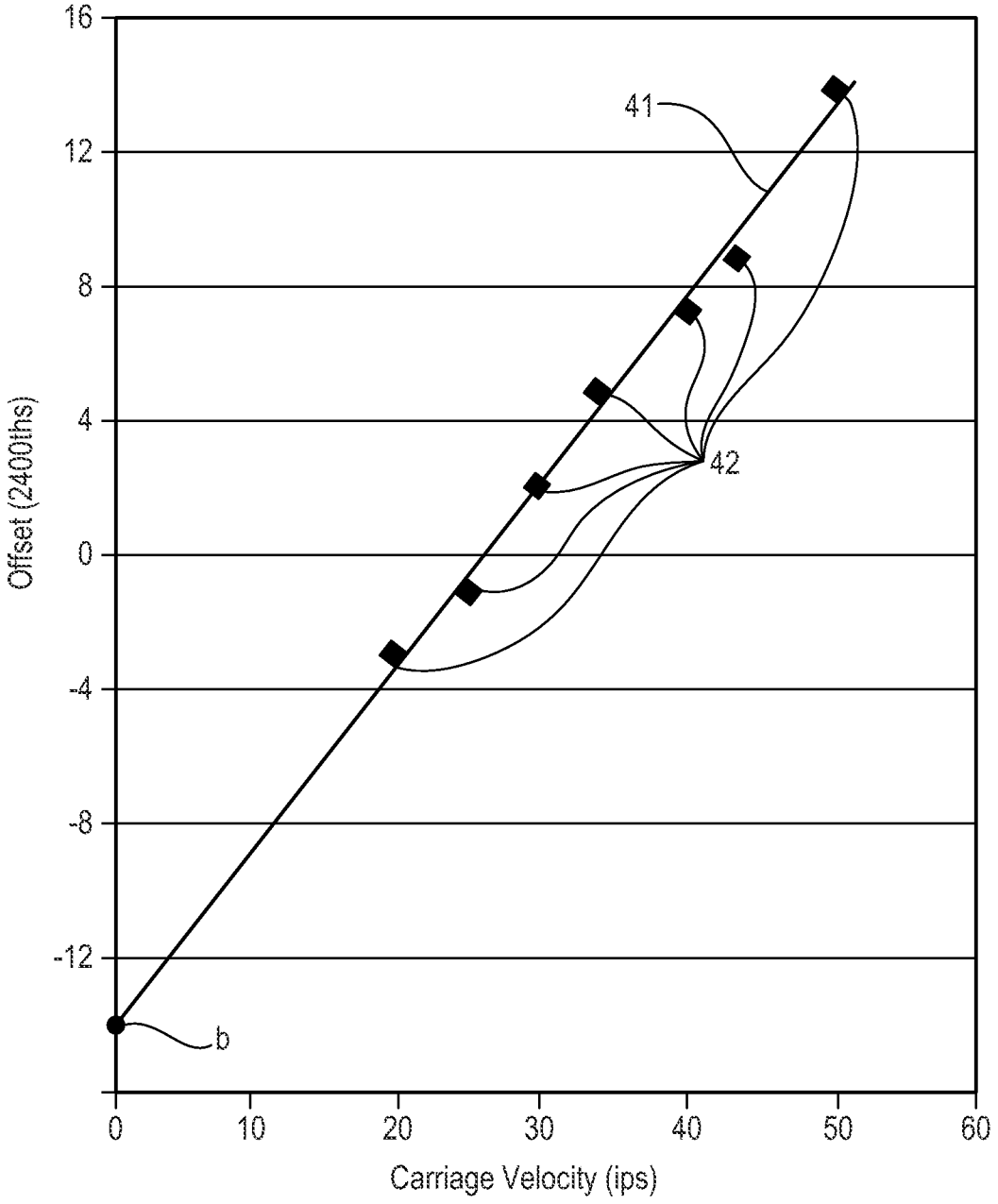
FIG. 4 is a graph illustrating a line of best fit including a slope and y-intercept corresponding to a data set of bi-directional alignment error at a plurality of carriage speeds of a printing system according to an example.

FIG. 4 is a graph illustrating a line of best fit including a slope and y-intercept corresponding to a data set of bi-directional alignment error at a plurality of carriage speeds of a printing system according to an example. Referring to FIG. 4, in some examples, a graph includes offset (bi-directional alignment error) along the y-axis in units of $2400^{th}$ seconds and carriage velocity (carriage speed) along the x-axis in units of inches per second (ips). The squared dots represent the respective offset (bi-directional alignment error) 42 at the respective carriage speeds. That is, squared dots are the data set corresponding to the bi-directional alignment error 42 at a plurality of carriage speeds. The graph also includes a line 41 such as a straight line corresponding to the best fit of the data set. The line 41 includes a slope m and y-intercept b. In some examples, the line 41 may be represented by the formula, y=mx+b, where m is the slope of the line, b is the y-intercept, y is a respective value along the y-axis, and x is a respective value along the x axis. The slope m represents a respective change in y divided by a respective change in x.

Figure 5:
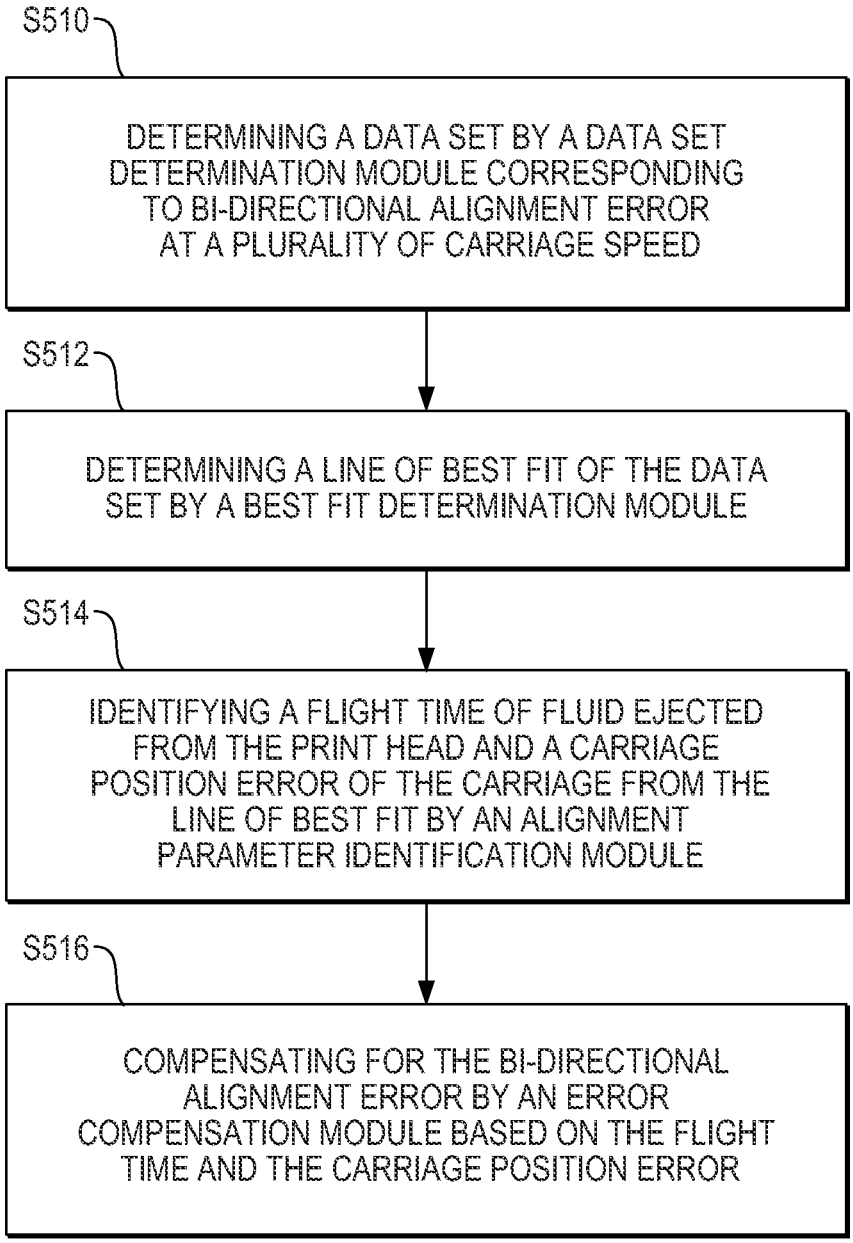
FIG. 5 is a flowchart illustrating a method of compensating for bi-directional alignment error in a printing system including a carriage, a print head disposed thereon, and a bi-directional printing mode according to an example.

FIG. 5 is a flowchart illustrating a method of compensating for bi-directional alignment error in a printing system including a carriage, a print head disposed thereon, and a bi-directional printing mode according to an example. Referring to FIG. 5, in block S510, a data set is determined by a data set determination module corresponding to bi-directional alignment error at a plurality of carriage speeds. In some examples, the determining a data set corresponding to the bi-directional alignment error at a plurality of carriage speeds may include printing a test pattern by the print head corresponding to a forward direction and a reverse direction in a bi-directional printing mode. For example, the test pattern may include a first set of rows of printed vertical line patterns. Each one of the respective rows of printed vertical line patterns may correspond to a different carriage speed. The determining a data set corresponding to the bi-directional alignment error at a plurality of carriage speeds may also include analyzing a test pattern by a test pattern analyzer module to provide a data set corresponding to the test pattern. For example, the test pattern analyzer module may include at least one of a scanner and a sensor. The sensor may be a light emitting diode sensor. For example, the scanner and/or sensor may detect the various vertical line patterns and/or determine the spacing there between.

In block S512, a line of best fit of the data set is determined by a best fit determination module. In some examples, the determining a line of best fit of the data set by a best fit determination module may include performing a simple linear regression. For example, the best fit determination module may perform a line fitting algorithm. In some examples, the determining a line of best fit of the data set by a best fit determination module may include performing a simple linear regression. The determining a line of best fit of the data set by the best fit determination module may also include identifying a formula including a slope and y-intercept corresponding to the line of best fit. The flight time may correspond to the slope of the formula corresponding to the line of best fit. The carriage position error may correspond to the y-intercept of the formula corresponding to the line of best fit.

In block S514, a flight time of fluid ejected from the print head and a carriage position error of the carriage is identified by an alignment parameter identification module from the line of best fit. For example, the ejection of fluid from the print head may be in a form of respective ink drops. In block S516, the bi-directional alignment error is compensated for by an error compensation module based on the flight time and the carriage position error. For example, this may be accomplished by adjusting the drop ejection time based on the flight time and adjusting the drop ejection position based on the carriage position error.

Figure 6:
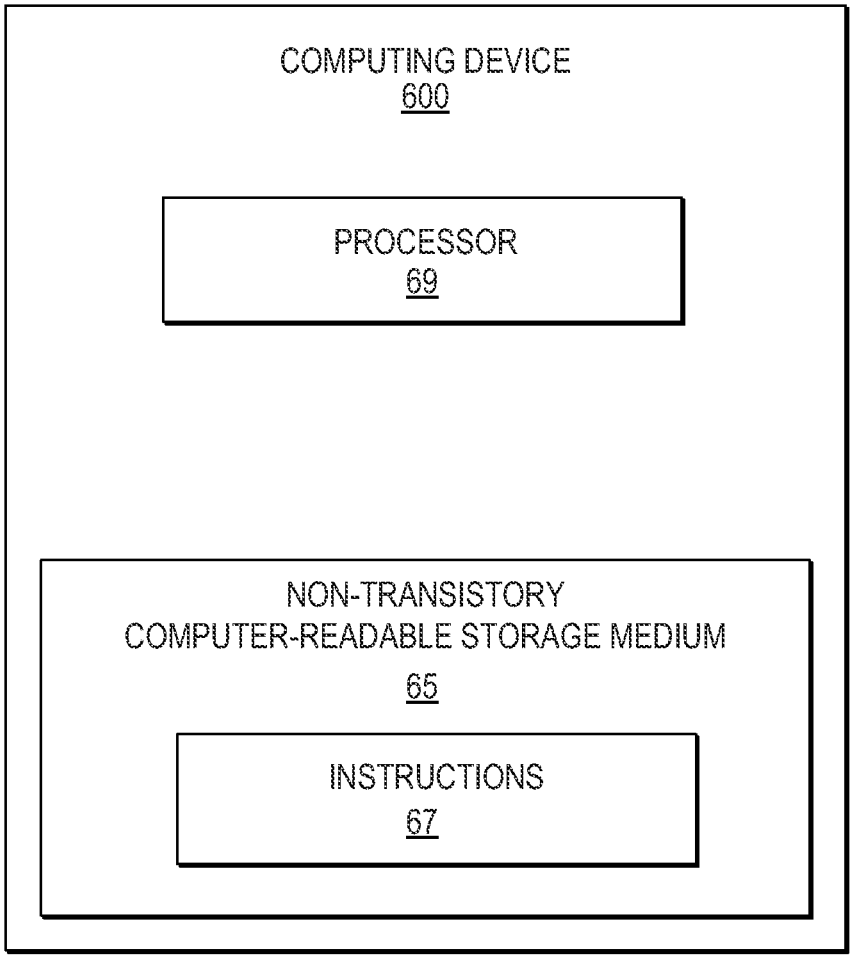
FIG. 6 is a block diagram illustrating a computing device such as a printing system including a processor and a non-transitory, computer-readable storage medium to store instructions to operate a printing system including a carriage, a print head disposed thereon, and a bi-directional printing mode to compensate for bi-directional alignment error according to an example.

FIG. 6 is a block diagram illustrating a computing device such as a printing system including a processor and a non-transitory, computer-readable storage medium to store instructions to operate a printing system including a carriage, a print head disposed thereon, and a bi-directional printing mode to compensate for bi-directional alignment error according to an example. Referring to FIG. 6, in some examples, the non-transitory, computer-readable storage medium 65 may be included in a computing device 600 such as a printing system. In some examples, the non-transitory, computer-readable storage medium 65 may be implemented in whole or in part as instructions 67 such as computer-implemented instructions stored in the computing device locally or remotely, for example, in a server or a host computing device considered herein to be part of the printing system.

Referring to FIG. 6, in some examples, the non-transitory, computer-readable storage medium 65 may correspond to a storage device that stores instructions 67, such as computer-implemented instructions and/or programming code, and the like. For example, the non-transitory, computer-readable storage medium 65 may include a non-volatile memory, a volatile memory, and/or a storage device. Examples of non-volatile memory include, but are not limited to, electrically erasable programmable read only memory (EEPROM) and read only memory (ROM). Examples of volatile memory include, but are not limited to, static random access memory (SRAM), and dynamic random access memory (DRAM).

Referring to FIG. 6, examples of storage devices include, but are not limited to, hard disk drives, compact disc drives, digital versatile disc drives, optical drives, and flash memory devices. In some examples, the non-transitory, computer-readable storage medium 65 may even be paper or another suitable medium upon which the instructions 67 are printed, as the instructions 67 can be electronically captured, via, for instance, optical scanning of the paper or other medium, then compiled, interpreted or otherwise processed in a single manner, if necessary, and then stored therein. A processor 69 generally retrieves and executes the instructions 67 stored in the non-transitory, computer-readable storage medium 65, for example, to operate a computing device 600 such as a printing system having a carriage and a print head disposed thereon to compensate for bi-directional alignment error in accordance with an example. In an example, the non-transitory, computer-readable storage medium 65 can be accessed by the processor 69.

It is to be understood that the flowchart of FIG. 5 illustrates architecture, functionality, and/or operation of examples of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 5 illustrates a specific order of execution, the order of execution may differ from that which is depicted. For example, the order of execution of two or more blocks may be scrambled relative to the order illustrated. Also, two or more blocks illustrated in succession in FIG. 5 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and theft conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A method of compensating for bi-directional alignment error in a printing system including a carriage and a print head disposed thereon and having a bi-directional printing mode, the method comprising:

determining a data set by a data set determination module corresponding to bi-directional alignment error at a plurality of carriage speeds;

determining a line of best fit of the data set by a best fit determination module;

identifying a flight time of fluid ejected from the print head and a carriage position error of the carriage from the line of best fit by an alignment parameter identification module; and compensating for the bi-directional alignment error by an error compensation module based on the flight time and the carriage position error.

2. The method according to claim 1, wherein the determining a data set corresponding to the bi-directional alignment error at a plurality of carriage speeds comprises:

printing a test pattern by the print head corresponding to a forward direction and a reverse direction in a bi-directional printing mode; and analyzing a test pattern by a test pattern analyzer module to provide a data set corresponding to the test pattern.

3. The method according to claim 2, wherein the test pattern comprises:

a first set of rows of printed vertical line patterns, each one of the respective rows of printed vertical line patterns corresponds to a different carriage speed.

4. The method according to claim 2, wherein the test pattern analyzer module comprises at least one of a scanner and a sensor.

5. The method according to claim 4, wherein the sensor further comprises:

a light emitting diode sensor.

6. The method according to claim 1, wherein the determining a line of best fit of the data set by a best fit determination module comprises:

performing a simple linear regression.

7. The method according to claim 6, wherein the determining a line of best fit of the data set by the best fit determination module comprises:

identifying a formula including a slope and y-intercept corresponding to the line of best fit.

8. The method according to claim 7, wherein the flight time corresponds to the slope of the formula corresponding to the line of best fit.

9. The method according to claim 7, wherein the carriage position error corresponds to the y-intercept of the formula corresponding to the line of best fit.

10. A printing system, comprising:

a carriage to move across a print zone in a forward direction and a reverse direction in a bi-directional printing mode;

a print head disposed on the carriage, the print head to eject fluid to a substrate to form an image in a print mode and to form a test pattern corresponding to the forward direction and the reverse direction in a test mode; and a bi-directional error compensation device to compensate for bi-directional alignment error, including:

a data set determination module to determine a data set corresponding to the bi-directional alignment error at a plurality of carriage speeds, the data set determination module including a test pattern analyzer module to analyze the test pattern and to provide a data set corresponding to the test pattern;

a best fit determination module to determine a line of best fit of the data set;

an alignment parameter identification module to identify a flight time of fluid ejected from the print head and a carriage position error of the carriage from the line of best fit; and an error compensation module to compensate for bi-directional alignment error based on the flight time and the carriage position error.

11. The printing system according to claim 10, wherein the test pattern comprises:

a first set of rows of printed vertical line patterns, each one of the respective rows of printed vertical line patterns corresponds to a different carriage speed.

12. The printing system according to claim 10, wherein the test pattern analyzer module comprises at least one of a scanner and a sensor.

13. The printing system according to claim 12, wherein the sensor further comprises:

a light emitting diode sensor.

14. The printing system according to claim 10, wherein the best fit determination module is configured to perform a simple linear regression to determine the line of best fit of the data set and to identify a formula including a slope and y-intercept corresponding to the line of best fit.

15. The printing system according to claim 14, wherein the flight time corresponds to the slope of the formula corresponding to the line of best fit and the carriage position error corresponds to the y-intercept of the formula corresponding to the line of best fit.

16. The printing system of claim 10, wherein the error compensation module compensates for bi-directional alignment error by at least adjusting drop ejection time based on the flight time and adjusting drop ejection position based on the carriage position error.

17. A non-transitory computer-readable storage medium having computer executable instructions stored thereon to operate a printing system including a carriage, a print head disposed thereon, and a bi-directional printing mode to compensate for bi-directional alignment error, the instructions are executable by a processor to:

determine a data set by a data set determination module corresponding to the bi-directional alignment error at a plurality of carriage speeds including printing a test pattern by the print head corresponding to a plurality of printing directions and analyzing a test pattern by a test pattern analyzer module to provide a data set corresponding to the test pattern, determine a line of best fit of the data set by a best fit determination module;

identify a flight time of fluid ejected from the print head and a carriage position error of the carriage from the line of best fit by an alignment parameter identification module; and compensate for bi-directional alignment error by an error compensation module based on the flight time and the carriage position error.

18. The non-transitory computer-readable storage medium according to claim 17, wherein the test pattern comprises:

a first set of rows of printed vertical line patterns, each one of the respective rows of printed vertical line patterns corresponds to a different carriage speed.

19. The non-transitory computer-readable storage medium according to claim 17, wherein the determining a line of best fit of the data set by a best fit determination module comprises:

performing a simple linear regression and identifying a formula including a slope and y-intercept corresponding to the line of best fit.

20. The non-transitory computer-readable storage medium method according to claim 19, wherein the flight time corresponds to the slope of the formula corresponding to the line of best fit.

21. The non-transitory computer-readable storage medium according to claim 20, wherein the carriage position error corresponds to the y-intercept of the formula corresponding to the line of best fit.

* * * * *

UNITED STATES PATENT AND TRADEMARK OFFICE

CERTIFICATE OF CORRECTION

PATENT NO. : 8,991,960 B2
APPLICATION NO. : 13/593578
DATED : March 31, 2015
INVENTOR(S) : Greg Hargis et al.

It is certified that error appears in the above-identified patent and that said Letters Patent is hereby corrected as shown below:

In the Claims

In column 8, line 56, in Claim 20, delete "method according" and insert -- according --, therefor.

Signed and Sealed this
Sixteenth Day of February, 2016

Michelle K. Lee

Michelle K. Lee
*Director of the United States Patent and Trademark Office*